US006183570B1

(12) United States Patent
Kawaguchi et al.

(10) Patent No.: US 6,183,570 B1
(45) Date of Patent: Feb. 6, 2001

(54) SURFACE TREATMENT PROCESS OF METALLIC MATERIAL AND METALLIC MATERIAL OBTAINED THEREBY

(75) Inventors: Jun Kawaguchi; Hiroyuki Iizuka, both of Tokyo (JP)

(73) Assignee: Nihon Parkerizing Co., Ltd., Tokyo (JP)

( * ) Notice: Under 35 U.S.C. 154(b), the term of this patent shall be extended for 0 days.

(21) Appl. No.: 09/291,981

(22) Filed: Apr. 15, 1999

(30) Foreign Application Priority Data

Apr. 16, 1998 (JP) ..... 10-106139

(51) Int. Cl.[7] ..... C23C 22/05
(52) U.S. Cl. ..... 148/243; 148/280
(58) Field of Search ..... 148/243, 255, 148/256, 262, 265, 269, 275, 280, 282; 427/419.1, 208.8; 428/687

(56) References Cited

U.S. PATENT DOCUMENTS 1,723,067 * 8/1929 Pacz ..... 148/269
2,137,988 * 11/1938 Hempel ..... 148/275
2,460,896 * 2/1949 Meyer ..... 148/269
2,800,422 * 7/1957 Piccinelli ..... 148/255
3,434,890 * 3/1969 Aronberg ..... 148/269
4,650,525 * 3/1987 Yoshida et al. ..... 148/265
5,116,430 * 5/1992 Hirai et al. ..... 148/518
5,164,235 * 11/1992 Chao ..... 148/282

* cited by examiner

*Primary Examiner*—John Sheehan
*Assistant Examiner*—Andrew L. Oltmans
(74) *Attorney, Agent, or Firm*—Pillsbury Madison & Sutro LLP

(57) ABSTRACT

There is provided a surface treatment method of metal that can endow the surface of a metallic material with strong bonding force in a simple process regardless of the profile and the substance of the metallic material as well as a metallic material obtained by such a method. The method comprises a first step of conducting a chemical etching process accompanied by formation of a film coat on the metal surface and a second step of chemically removing the film coat formed on the metal surface in the first step. If necessary, it may further comprise a third step of forming a thin layer on the metal surface after the second step.

7 Claims, 2 Drawing Sheets

Etching Pits Formed According To The Invention

SURFACE TREATMENT PROCESS OF METALLIC MATERIAL AND METALLIC MATERIAL OBTAINED THEREBY

BACKGROUND OF THE INVENTION

1. Field of the Invention

This invention relates to a surface treatment method of metallic material to be used for roughening the surface of metal for the purpose of preventing halation and glaring. Also, it relates to a surface treatment method of metallic material for providing an excellent adhesiveness with an organic polymer material. The present invention also relates to a metallic material obtained by such a surface treatment method. For the purpose of the invention, the term metallic material refers to any of metals, and metal parts subjected to the surface treatment.

2. Description of the Related Art

Generally, two surface treating methods are known for firmly bonding an organic polymer material to a metallic material. The first method is a method of roughening the surface of the metallic material in order to provide the surface with many small dents having a wedge effect for the organic polymer material. The second method is a method of forming a layer of a third material that is highly adhesive both to the metallic material and the organic polymer material on the surface of the metallic material.

When a mechanical process, for example a shot blasting process, is used for the first method, many small dents are formed on the surface of the metallic material by injecting hard fine particles of alumina, silicon carbide or silicon nitride onto the surface of the metallic material. With this process, the effective surface area of the metallic material for binding with the organic polymer material is increased, and the dents formed on the surface of the metallic material are filled with the organic polymer material to give rise to a wedge of the organic polymer material so that the two materials will be firmly bonded to each other.

However, such a mechanical process as shot blasting process has drawbacks in that it cannot be used when the metallic material has a profile of a thin sheet because the profile of the thin sheet can easily be changed by the shot blasting process. Another disadvantage is that the surface cannot be evenly roughened if the metallic material has a complex profile. Additionally, a metallic material subjected to a mechanical process has to be bonded with an organic polymer material immediately after the surface treatment, because the surface of the metallic material is active as a result of having its protective surface layer removed, so that the adhesiveness of the surface will gradually be lost as the surface is oxidized with time. For these reasons it is inconvenient to use this mechanical process.

When a chemical process is used for the first method, the surface of the metallic material to be treated is brought into contact with hydrochloric acid, sulfuric acid or nitric acid to chemically etch and roughen the surface of the metallic material. Since the surface of metallic material is chemically not uniform microscopically due to the difference of its metal structure and the presence of nonmetallic inclusions and crystal grain boundaries, chemically active areas will be more predominantly etched to produce many small etching pits on the surface. With this process, however, a remarkable roughening effect may not be achieved depending on the kind of metallic material. Also, small etching pits, which are produced, can be etched out and disappear when etching is performed excessively. Further, this process normally does not provide etching pits having a sharp configuration when compared with the mechanical process.

Regarding, the second method of forming a layer of a third material on the surface of the metallic material, a variety of treatment processes have been performed.

A treatment of a steel or zinc type material using phosphate solution, that of an aluminum type material using chromate solution, and that of a copper type material forming a copper oxide film can be done. Also, the application of a silane coupling agent onto the surface of a variety of different metallic material, has also been performed.

This second method of forming a layer of a third material is advantageous over the above described mechanical method because it results in auxiliary effects. As the surface of the metallic material is covered by a layer of a third material, it becomes chemically less active and less prone to rust. The surface becomes highly anti-corrosive after an organic polymer material is bonded thereto.

Particularly, in a process using phosphate layer or copper oxide layer with the second method, the metallic material will be etched simultaneously with the formation of the layer thereon, and the formed layer will comprise fine crystal grains with a size between a sub-micron and tens of several microns. Thus the surface of the metallic material is covered by many small etching pits as well as the adhesive layer, so that not only the layer itself will show an excellent adhesiveness but also the surface of the metallic material itself will show an effective mechanical bonding effect.

However, when the surface of a metallic material is etched mainly for the purpose of roughening, the structure of the layer formed on it can become coarse thereby degrading its strength and reduce its bonding force. Therefore, it is difficult in the second method to find optimal etching conditions for such a roughening operation. Accordingly, while the second method may be used for forming the layer for painting over it, it is not suitable for forming a layer having sufficient bonding force. Therefore, for the surface of a metallic material bonded with rubber or some other organic polymer material, where shearing stress and/or peeling stress may appear after the bonding operation, the first and the second method have to be used together.

The second method of applying a silane coupling agent can be used for many different types of metallic materials compared with the above described chemical process. It can be used in a simple operation of applying a silane coupling agent to the metallic material. However, the produced layer in this case will be very thin and the layer does not provide a sufficient bonding force with organic polymer materials.

As explained above, the mechanical method has a weak point in that it can be difficult to apply to the metallic material if the metallic material has a thin sheet profile. Also in this method the metallic material becomes rusty. The etching process in this method has a weak point in that a sharp etching pit is difficult to obtain. The method of forming a layer of a third material has a weak point in that the adhesive strength with an organic polymer material tends to be insufficient.

Furthermore, a roughened surface of metallic materials is required in several fields for optical reasons. Such metallic materials may have a plane surface, a curved surface or a more complicated surface. Therefore, there has been a need for a method, which will uniformly roughen the surface of a metallic material regardless of the profile of the surface.

SUMMARY OF THE INVENTION

In view of the above identified problems of the known methods of roughening the surface of metallic material, it is the object of the present invention to provide a new surface treatment process for metallic material that can endow the surface of the metallic material with strong bonding force with an organic polymer material in a simple process regardless of the profile of the metallic material.

The inventors of the present invention determined that a chemical process is most suitable for treating the surface of the metallic material since it uniformly reacts with the surface of the metallic material regardless of the surface profile of the metallic material, and that many deep and sharp etching pits could be exploited by roughening the surface in order to provide a strong bonding force by wedge effect to the surface. The second aspect of the present invention is based on a finding that the metal surface can be provided with an increased adhesiveness and an enhanced anti-oxidation effect when a layer of a third material is additionally formed after the roughening operation.

According to the present invention, there is provided a surface treatment process of metallic material comprising a first step of conducting a chemical etching process accompanied by formation of a film like coat (hereinafter referred to as film coat) on the metal surface and a second step of chemically removing the film coat, which was formed on the metal surface in the first step.

Since this invention utilizes contact of the metal surface with a chemical agent, it can be applied uniformly to any of the varied profiles of the metallic material to be treated. Additionally, according to a finding of inventors, a chemically etching of a metallic material can produce sharp and deep etching pits on the surface when the etching process accompanies a film coat formation.

A metal surface subjected to an ordinary chemical etching without a film coat formation microscopically shows etching pits having rounded edges. On the other hand, a metal surface subjected to a chemical etching process according to the invention provides sharply edged etching pits. Because of sharply edged etching pits formed by the invention, the surface of the metallic material of the invention shows a stronger wedge effect than the surface obtained by an ordinary etching process when bonded to an organic polymer material.

When the metallic material is selected from iron type materials, zinc type materials, aluminum type materials and copper type materials, the first step of the invention may be a chemical etching process using preferably an aqueous solution containing at least one of a heavy metal ions selected from zinc ion, nickel ion, cobalt ion, calcium ion and manganese ion, and showing a pH value between 1 and 5.

When the metallic material is selected from titanium type materials, zirconium type materials or aluminum type materials, the first step of the invention may be a chemical etching process using preferably an acidic aqueous solution containing at least fluoric compound ions, phosphoric acid ions and a metallic ion selected from alkali metal group.

When the metallic material is selected from an amphoteric metal group, the first step of the invention may be a chemical etching process using preferably an alkaline aqueous solution containing at least one heavy metal ion or one heavy metal acid ion selected from zinc ion, nickel ion, cobalt ion, molybdic acid ion, tangstic acid ion, chromic acid ion, vanadic acid ion and iron ion.

When the metallic material is stainless steel, the first step of the invention may be a chemical etching process using preferably an aqueous solution containing at least oxalic acid ion and fluoric ion.

Also, when the metallic material is selected from a copper type material, the first step of a method of the invention may be a chemical etching process using preferably a strong alkaline aqueous solution containing at least copper ion and an oxidizing agent.

The second step of chemically removing the film coat in the invention, is preferably a process of removing only the film coat, which is formed in the first step without corroding the metal surface.

However, if it corrodes the metal surface to a slight extent, it can be used by appropriately regulating the treating time and the treating temperature of the process.

When the metallic material is an iron type material, the film coat can be removed without corroding the metal surface by using an aqueous solution containing chromic acid or a strong alkaline aqueous solution. When the metallic material is of a copper type, the use of hydrochloric acid is effective in the second step. The use of nitric acid is recommended for an aluminum type material in the second step.

An electrolytic process can be used for the first step and/or the second step. In this process a desired surface condition can be achieved easily by appropriately selecting the electrolytic operation.

A surface treatment method of metallic material according to the invention is further characterized by additionally performing a third step of forming a thin layer of a third material on the metal surface after the second step.

The third step of forming a layer of a third material can be conducted independently from the first step and the second step. The type of layer as well as the forming condition of the layer of a third material can be freely selected independently from the first step and the second step. The layer of a third material formed on the surface of the metallic material may effectively prevent oxidation of the surface that can otherwise take place with time.

A process using a silane coupling agent or a chromate agent may be employed for the third step. Also, some of the solution listed above for the first step may be used for the third step. Although the first step and the third step of the present invention are independent from each other, the some sort of chemical agent can be used in an optimal manner to produce a highly adhesive surface of the metallic material in the third step.

The surface of a metallic material subjected to the first step and second step of the invention is uniformly roughened. The surface roughness, Rz, of a metallic material to be bonded with an organic polymer is preferably 1.5 $\mu$m or more. Such a surface roughness can easily be obtained by the first step and the second step of the invention. Then, the adhesiveness of the surface of the metallic material can be improved by forming a layer of a third material on the surface according to the third step of the invention.

The produced layer of a third material may effectively prevent oxidation of the surface that can otherwise take place with elapse of time.

DETAILED DESCRIPTION

1. Metallic material and organic polymer material applicable in the invention:

Metallic materials that can effectively be treated by the invention are those of the iron type, zinc type, aluminum type, magnesium type, titanium type, zirconium type, copper type and nickel type. In this specification the term, iron type includes metallic iron, steel, steel alloy including stainless steel. Also, the term zinc type includes metallic zinc, zinc alloy, zinc plated metal and metal being plated by zinc alloy. In the same way, in this invention, the term of type should be construed to include a metallic alloy and a product being plated by the metal and metallic alloy.

When a method according to the invention is applied, the surface of the metallic material to be treated should preferably be cleaned previously to remove any stains, oil and grease by means of an organic solvent or an alkaline degreasing agent. Oxide film should preferably be removed by means of acid pickling using hydrochloric acid, sulfuric acid, nitric acid or hydrofluoric acid depending on the type of the metallic material. However this acid pickling is not used for the purpose of etching the surface of the metallic material unlike the first step of the invention. It should be conducted only to remove the oxide film and it is not necessary to produce etching pits on the surface of the metallic material.

Regarding the organic polymer materials that can be bonded to the surface of a metallic material, many type of organic polymer materials including rubber, plastics (vinylchloride, acryl, polyethylene, polypropylene, etc.) and adhesives agent (epoxy, phenol, etc.) can be used.

2. The first step of the invention:

The first step of the invention is conducted in order to form many suitable etching pits on the surface of the metallic material.

Usual chemical etching can produce many etching pit on the metallic material. For example, an acidic etching solution may form many etching pits on the steel surface while an acidic or alkaline etching solution may form many etching pits on the surface of aluminum or zinc. However, it is difficult to produce suitable etching pits by means of such a solution. It is critically important for the invention to use a solution that can form an insoluble film coat on the surface of the metallic material simultaneously with the etching of the surface of the metallic material.

More specifically, it is highly difficult by means of an ordinary etching solution to produce etching pits on the surface of a metallic material that can provide a mechanical wedge effect and a strong adhesiveness when bonding with an organic polymer material.

The first step of the present invention will be explained by referring to the accompanying drawings.

Figure 1:
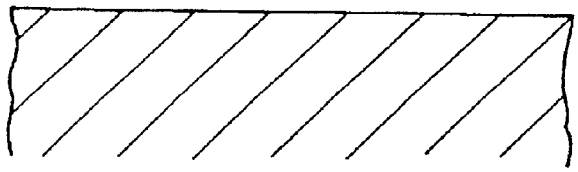
FIG. 1 is a cross sectional view of a metallic material before treatment.

FIG. 1 is a cross sectional view of a metallic material, showing the surface and its vicinity. When the surface of the metallic material is brought into contact with a solution of the first step of the invention, microscopically local anode/cathode reactions take place. At the local anode sites of the metallic material, metallic material are etched and dissolved there. On the other hand, an insoluble film coat material is deposited at the local cathode sites of the metallic material.

Figure 2:
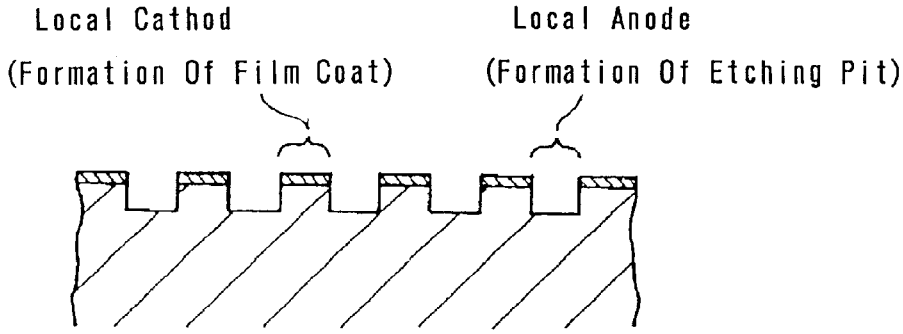
FIG. 2 is a cross sectional view of the metallic material in a early stage of the first step, showing etching pit and film coat formed by a local anode/cathode reaction in the first step of the invention.
Figure 3:
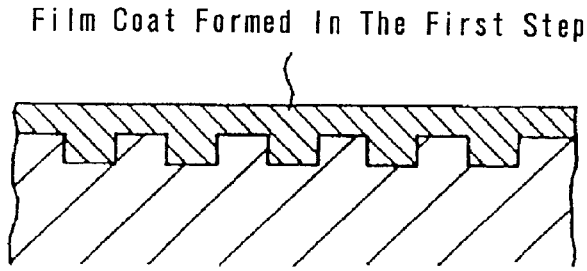
FIG. 3 is a cross sectional view of the metallic material in a final stage of the first step, showing etching pits covered by the film coat.

FIG. 2 is a cross sectional view of the metallic material in a early stage of the first step, showing etching pits which appeared at anode sites and insoluble film coat material, which was deposited at the cathode sites of the surface of the metallic material. As seen from FIG. 2, deep etching pits can be obtained preventing excessive etching at the cathode sites, by means of the first step of the invention. As shown in FIG. 3, the film coat forming reaction terminates when the entire metal surface is covered by a film coat. However, it is not always necessary to continue the film coat forming reaction until it terminates by itself, because the obtained film coat itself is removed away in the second step.

Following are examples of treatment solutions that are applicable in the first step. However, other solutions may be applicable when it can etch anodes sites of the metal and simultaneously can deposit insoluble film coat material at cathode sites of the metal.

(1) When the metallic material is iron type, zinc type, aluminum type or copper type, an aqueous solution containing at least one heavy metal ion selected from zinc ion, nickel ion, cobalt ion, calcium ion and manganese ion, containing phosphoric acid ion and having the pH value regulated to be between 1 and 5 can be used in the first step.

When the metallic material is brought into contact with treatment solution of above, the surface is etched and simultaneously an insoluble film coat of phosphate of the heavy metal is formed on the surface so that the desired etching pits can be produced after the second step. Phosphate film coat formed by these solution usually contains metallic ion of the treated metallic materials such as iron phosphate, zinc phosphate and/or aluminum phosphate.

(2) When the metallic material is the titanium type or the zirconium type, an acidic aqueous solution (pH: 1~6) containing at least ion of a fluoric compound, phosphoric acid ion and alkali metal ion ($Li^+$, $Na^+$, $K^+$, $Rb^+$, etc.) can suitably be used.

When the metallic material is brought into contact with treatment solution of above, the surface is etched and simultaneously an insoluble film coat containing titanium phosphate or zirconium phosphate, also containing titanium fluoride or zirconium fluoride is formed at the cathode sites of the surface so that desired etching pits are produced on the surface. This treatment solution can be used also for the aluminum type.

(3) When the metallic material is of the amphoteric metal type, for example the aluminum type or the zinc type, an alkaline aqueous solution (pH: 7~14) containing heavy metal ion or heavy metal acid ion such as zinc ion, nickel ion, cobalt ion, molybdic acid ion, tangstic acid ions, chromic acid ions, vanadic acid ions and iron ions can suitably be used.

When the metallic material is brought into contact with a treatment solution of above, metallic ion contained in the treatment solution are substituted by metal of the metallic material and deposited to form a film coat of metallic salts or metal compounds.

(4) When the metallic material is stainless steel, an aqueous solution containing oxalic acid ion and ion of fluoric compounds can suitably be used for the treatment solution.

When the stainless steel is brought into contact with a treatment solution of above, the surface is etched and simultaneously a film coat of iron oxalate is formed so that desired etching pits are produced on the surface.

(5) When the metallic material is the copper type, a strong alkaline aqueous solution containing copper ion and an oxidizing agent can be used for the first step.

When the metallic material is brought into contact with such a treatment solution, the surface is etched and simultaneously a film coat of copper oxide is formed on the surface.

As described above, any treatment solution that can etch the surface of the metallic material and simultaneously form an insoluble film coat may be used in the first step of the present invention. And the extent of etching can be regulated by appropriately selecting the etching temperature of the solution, the duration of the treatment, the concentrations of the ingredients, pH and the concentration of an oxidizing agent.

An electrolytic process may effectively be used for the first step. In the present invention, an electrolytic process refers to a process of using the metallic material as an electrode in a treatment solution, applying a electric current between the metallic material and the other electrode. With an electrolytic method, the etching and the formation of the film coat can be controlled by the power supply rate.

Most of the treatment solutions described above can be used for the electrolyte solution. However, only etching will take place when the metallic material is used as anode, whereas only a film coat formation will take place when the metallic material is used as cathode. Therefore, anodic electrolysis and cathodic electrolysis should be conducted alternatingly. An electrolytic process using an AC current or AC pulse current can be used. Changing the direction, amplitude and intensity of the electric current in preferable cycle can also be used for this purpose.

3. The second step of the invention:

The second step according to the invention is conducted in order to remove the film coat formed in the first step.

The surface of the metallic material shows many small etching pits and is covered by the film coat as the result of the first step. The film coat has to be removed in the second step. As seen from FIG. 3, after the first step, the surface of the metallic material is entirely covered by a film coat. The film coat may show a reduced strength. The surface of the metallic material having a film coat thereon is not suited for bonding the metallic material to an organic polymer material with strong bonding force. For the reasons explained above, the surface of the metallic material itself has to be exposed, the film coat has to be removed as a matter of course.

The second step consists of dissolving and removing the film coat by using an appropriate treatment solution.

A conventional acidic or alkaline aqueous solution may be used for the treatment solution of the second step, because it is used only to remove the film coat from the surface of the metallic material. However, when the treatment solution of the second step also dissolves the metallic material, the sharp profile of the etching pits formed on the surface of the metallic material will be changed. For this reason the etching process of the second step will have to be carried out quickly so as not to change the profile of the etching pits. Also, the treatment solution of the second step should be a solution that dissolves only the film coat and does not corrode the metallic material.

When the metallic material is the iron type, a chromic acid solution, caustic soda solution and caustic potash solution may be used for the treatment solution of the second step. When the metallic material is the copper type, an aqueous solution of hydrochloric acid may be used for the treatment solution of the second step. And when the metallic material is the aluminum type, an aqueous solution of nitric acid may be used for the treatment solution of the second step.

An electrolytic process may also be used for the second step as in the case of the first step. The operation of removing the film coat can easily be controlled with an electrolytic process by adjusting the power supply.

The electrolytic solution of the second step preferably shows a pH value between 4 and 9 if electric conductivity as an electrolyte is provided. The use of a strong acidic solution or a strong alkaline solution is not desirable because they can corrode the metallic material itself. Anodic electrolysis should be conducted so as to remove only the film coat.

Figure 4:
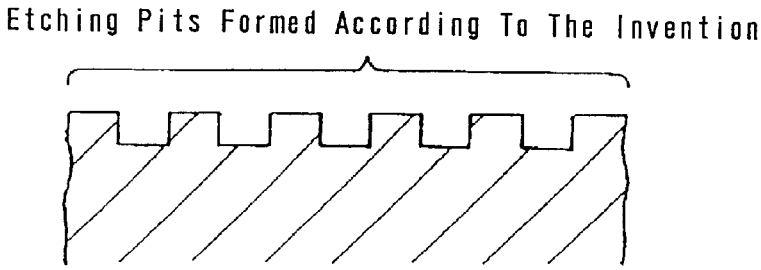
FIG. 4 is a cross sectional view of the metallic material after the second step, showing sharp etching pits appeared by removing the film coat.

4. Surface condition of the metallic material after the first and the second step:

As described above, after the first and second steps of the invention, the surface of the metallic material shows many etching pits of sharp profile as shown in FIG. 4.

According to the findings of the inventors of the present invention, the roughness of the surface of the metallic material preferably has a value of 1.5 $\mu$m or above defined by Rz if it is to be firmly bonded with an organic polymer material. More preferably, Rz should be a value between 1.5 and 15.0 $\mu$m and most preferably between 2.5 and 10.0 $\mu$m. A surface of the metallic material having such a surface roughness shows a very strong bonding force relative to an organic polymer material. Therefore, the first and the second steps should be so performed as to provide a surface of the metallic material having such Rz. When Rz shows a value less than 1.5 $\mu$m, the etching pit on the surface will be too shallow to expect a sufficient wedge effect. A large wedge effect may be expected with a large Rz value. However, it is difficult to realize an Rz value greater than 15.0 $\mu$m by means of a chemical process.

According to the inventors opinion, Rz is suitable to evaluate the bonding strength with the organic polymer material, since it can represent the roughness of large area of the metallic material. However, for another purpose, Ra may alternatively and advantageously be used as index to express the surface roughness of a metallic material from a microscopic point of view. A roughened surface with an Ra value greater than 0.2 $\mu$m can be produced easily and stably with a method according to the invention. However, the upper limit for Ra is about 2.0 $\mu$m for the reasons same as pointed out for Rz above.

Rz and Ra explained above can be obtained according to JIS-B-0601.

5. The third step of the invention:

The metallic material obtained after the second step shows the surface having many small etching pits of preferable profile. Therefore, the first and the second steps of the invention can provides a satisfactory effect of roughening the surface of a metallic material and the roughened surface may be satisfactorily effective for bonding it with the organic polymer material. However, the third step according to the invention, as will be described below, can further improve the bonding effect. And the layer of a third material formed on the metal surface as a result of the third step can effectively protect the metal surface against oxidation that may otherwise occur with time.

Figure 5:
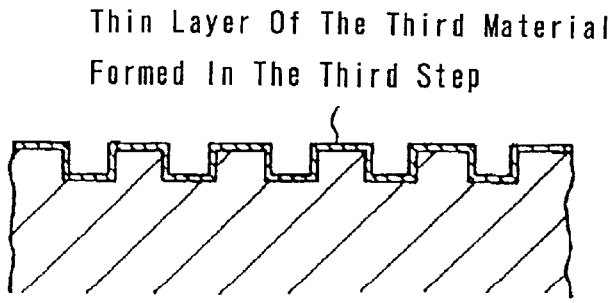
FIG. 5 is a cross sectional view of the metallic material after the third step, showing etching pits covered by a thin layer of the third material.

FIG. 5 is a cross sectional view of the metallic material after the third step, showing etching pits covered by a thin layer of the third material. Any material may be used for providing the layer of the third material so long as it produces a thin layer that has an excellent adhesiveness both with the surface of the metallic material and an organic polymer material. However, the layer of the third material produced by the third step should be thin enough in its thickness so that it does not fill up the etching pits of the surface produced by the first and the second step.

A silane coupling agent and an application type chromate agent may be recommended as a agent suitable to use for the third step. These agents may produce an adhesive layer for variety type of the metallic material.

A silane coupling agent that can be used for the third step is typically expressed by chemical formula as shown below:

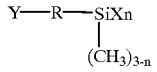

where Y is an organic functional group (such as vinyl group, epoxy group, methacryl group, amino group, mercapto group or chloro group), X is a hydrolytic group (such as alkoxyl group), R is an alkylene group having 1 to 4 carbon atoms and n is an integer between 1 and 3.

The third step will be conducted by applying the above silane coupling agent diluted with an appropriate solvent to the surface of the metallic material subjected to the first and second steps and then drying it. Then, a very thin adhesive layer will be formed on the surface of the metallic material.

An application type chromate agent preferably is a treatment solution containing hexavalent chromium ion and trivalent chromium ion. The concentration of trivalent chromium ion is preferable to be 0~50% of the concentration of total chromium ions.

When an application type chromate agent is used for the third step, it may simply be applied on to the surface of the metallic material and then dried. Then, a thin chromate layer, where trivalent chromium and hexavalent chromium are contained, will be formed on the surface of the metallic material. More reactive type chromate treatment solution obtained by decreasing its pH value or by adding a fluoric compound thereto can advantageously be used to produce a thin chromate layer on the surface of the aluminum type or the zinc type.

Other treatment solutions containing similar components with that described earlier for the first step may also be used for the third step. In such cases, operating condition may be selected differently from that of the first step, and highly adhesive layer may be formed on the surface of the metallic material in the third step. It is important that the layer produced in the third step does not fill up the etching pits of the metallic material formed in the first and the second step. It is also important to form a layer having a fine structure in itself in the third step of the invention.

For example, when phosphate layer is formed in the third step, it will be effective to add an oxidizing agent containing nitrous acid ions to the solution. It is also effective to apply a solution in which colloidal titanium is contained to the surface of the metallic material prior to the third step in order to make the layer have a more fine structure.

The thickness of the layer is preferably between 0.01 and 3.0 $\mu$m, more preferably between 0.01 and 0.5 $\mu$m. When the thickness is less than 0.01 $\mu$m, the layer does not provide a sufficient effect. When the thickness exceeds 3.0.m, on the other hand, the layer will fill up the etching pits produced as a result of the first and second steps.

6. Surface condition of the metallic material after the third step:

As shown in FIG. 5, the surface of a metallic material after the third step shows a roughened surface having many small etching pits of sharp profile, and the inside surface of each etching pits as well as the peak of the roughened surface are all covered completely by the layer of the third material. The surface of the metallic material obtained after the third step has a very strong adhesivensss with the organic polymer material, since many small etching pits give a strong adhesiveness to the surface of the metallic material by their wedge effect, and the layer itself has a strong adhesiveness both to the metallic material and organic polymer material. It is also important for the surface, after the third step, that Rz or Ra value in the second step are in the range as being specified in the explanation of the second step.

Now, the present invention will be described further by way of embodiment examples and comparative examples. In the following explanation unless otherwise noted, the concentration of any of the agents will be expressed by %.

Embodiment Example 1.

A specimen of a cold rolled steel plate (70×150×0.8 mm) having a surface cleansed by means of an alkaline degreasing agent was immersed into a manganese phosphate treatment solution heated to 90° C. for 10 minutes to form a manganese phosphate film coat at a rate of 14 g/m$^2$ on the surface. The manganese phosphate used in the above process had been prepared by adding manganese carbonate to an aqueous solution containing phosphoric acid by 30 g/l and nitric acid by 5 g/l so as to make it show a manganese ion concentration of 10 g/l.

The cold rolled steel plate specimen now carrying a manganese phosphate film coat was then immersed for 2 minutes in 10% hydrochloric acid solution at room temperature to remove the manganese phosphate film coat and washed with water immediately thereafter. The obtained cold rolled steel plate specimen was measured for surface coarseness to see values of Ra=0.4$\mu$m and Rz=2.6 $\mu$m.

After that the solution A and the solution B of a double solution type epoxy adhesive agent (High-Super 5®: tradename, available from Cemedine®) was thoroughly mixed to a ratio of 1:1 and the mixture was applied to the surface of the obtained cold rolled steel plate specimen at a rate of about 100 g/m$^2$ and then the specimen was left in that state for 24 hours. Then, the cold rolled steel plate specimen on to which the adhesive agent had been applied was immersed in an 5% NaOH aqueous solution, heated to 60° C. for 60 minutes and then washed with water. Thereafter, the specimen was securely held at an end thereof by a vice and was bent by the angle of 90° carrying the adhesive agent facing outward.

As a result, no peeling of the adhesive agent was observed in the bent area

Comparative Example 1

A cold rolled steel plate specimen, which was the same as the one used in Embodiment Example 1, was immersed in a 10% hydrochloric solution heated to 40° C. for 10 minutes, in place of subjecting it to a treatment using manganese phosphate, and washed with water immediately thereafter. At this stage, the obtained cold rolled steel plate specimen was measured for the surface roughness to see values of Ra =0.7 $\mu$m and Rz=4.7 $\mu$m.

Then, an epoxy adhesive agent was applied to the specimen as in Embodiment Example 1 and the adhesiveness of the specimen was evaluated in a manner described in Embodiment Example 1 to find that the adhesive agent had been peeled off in the bent area.

Comparative Example 2

An epoxy adhesive agent was applied to a cold rolled steel plate specimen carrying a manganese phosphate film coat as in Embodiment Example 1 without removing the manganese phosphate film coat by means of hydrochloric acid. Then, the adhesiveness of the specimen was evaluated in a manner described in Embodiment Example 1 to find that the adhesive agent had been peeled off in the bent area.

Embodiment Example 2

A specimen of a hot rolled steel plate (25.4×60.3×2.54 mm) having a surface cleansed by means of an alkaline 25 degreasing agent and having subsequently oxide scales removed therefrom by immersing it in 10% hydrochloric acid for 30 minutes at room temperature was immersed into a zinc calcium phosphate treatment solution heated to 90° C. for 10 minutes to form a zinc calcium phosphate film coat at a rate of 12 g/m$^2$ on the surface. The zinc calcium phosphate solution used in the above process had been prepared by adding zinc white and calcium hydroxide to an aqueous solution containing phosphoric acid by 15 g/l and nitric acid by 10 g/l so as to make it show a zinc ion concentration of 5 g/l and a calcium ion concentration of 3 g/l.

The hot rolled steel plate specimen now carrying a zinc calcium phosphate film coat was then immersed in an 10% hydrochloric acid solution at room temperature for 3 minutes to remove the manganese phosphate film coat and washed with water immediately thereafter. Then, an application type chromate solution with a reduced ratio of 30% (a solution obtained by reducing a 30% of the total chromium to trivalent chromium by adding methanol to an aqueous solution of chromic acid) was applied to the specimen to form a thin chromate layer at a rate of 30 mg/m$^2$ in terms of Cr (thickness: about 0.3 $\mu$m). The obtained hot rolled steel plate specimen was measured for surface roughness before and after the chromate treatment to see values of Ra=1.7 $\mu$m and Rz=10.8 $\mu$m for both before and after the treatment.

The obtained hot rolled steel plate specimen was then left in that state for 24 hours and then the primer agent (Kemrock 205®: trade name, available from Road®) and the top agent (Kemrock 220®: trade name available from Road®) of a dry type rubber adhesive were sequentially sprayed to a thickness of 15 $\mu$m for each. Then, a CR rubber piece (25.4×127×5.37 mm) was bonded to it according to JIS-K-6301 and then peeled off in a direction of 90° to prove a bonding strength of 16.3 kgf/cm$^2$.

Comparative Example 3

An epoxy adhesive agent was applied to a hot rolled steel plate specimen carrying a zinc calcium phosphate film coat as in Embodiment Example 2 without removing the zinc calcium phosphate film coat by means of hydrochloric acid. Then, a CR rubber piece was directly bonded to the specimen as in Embodiment Example 2 and the bonding strength was observed in the same manner to find a value of 14.2 kgf/cm$^2$.

Comparative Example 4

A hot rolled steel plate specimen same as the one used in Embodiment Example 2 was treated by a shot-blast in place of being subjected to a treatment using a zinc calcium phosphate agent and immediately a CR rubber piece was bonded thereto. The bonding strength was found to be 15.9 kgf/cm$^2$.

However, when the specimen subjected to a shot-blast treatment was left at room temperature for 6 hours before bonding a CR rubber piece thereto, the bonding strength fell to 5.3 kgf/cm$^2$. The peeled surface was found to have been slightly rusted. When the surface roughness of the specimen was observed immediately after the shot-blast treatment, values of Ra=0.7 $\mu$m and Rz=5.1 $\mu$m were obtained.

Embodiment Example 3

Figure 6:
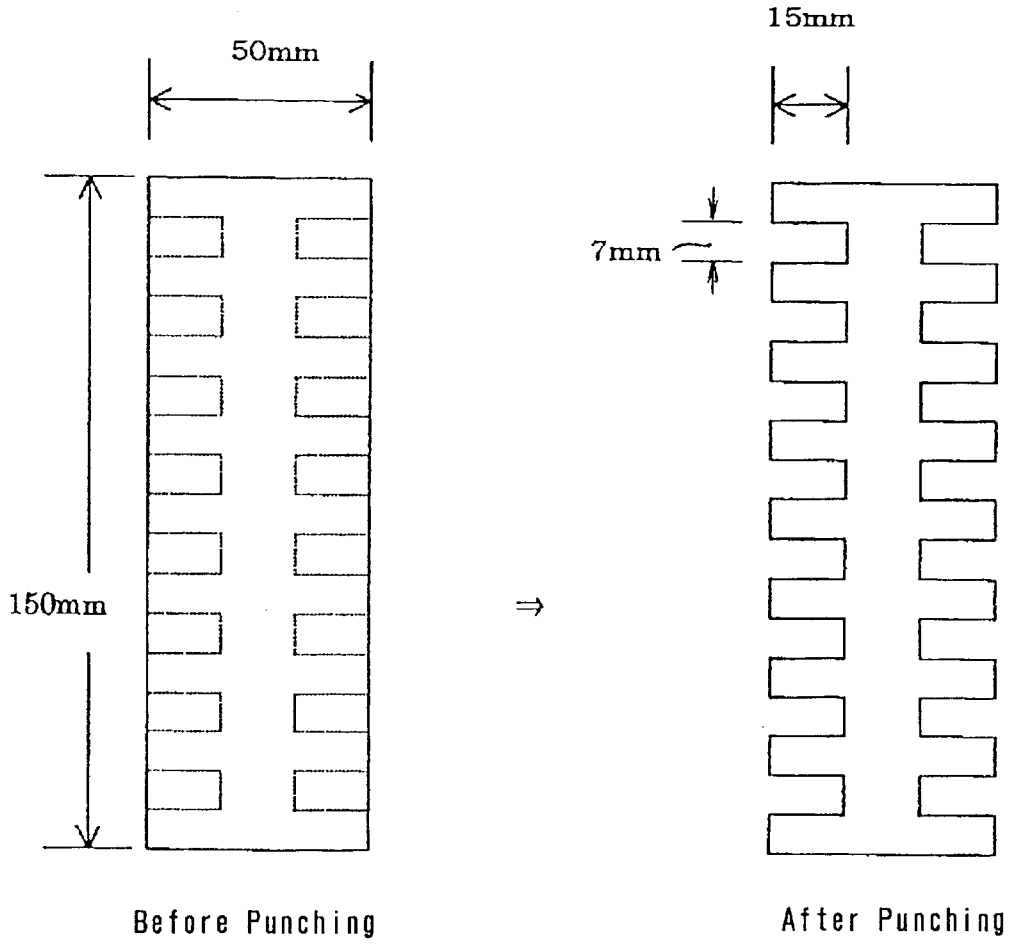
FIG. 6 shows plan views of a specimen of stainless steel plate used in the examples described hereinafter.

A specimen of a stainless steel plate ( JIS SUS304, 50×150×0.3 mm) with a profile as shown in FIG. 6 having a surface cleaned by means of an alkaline degreasing agent was immersed into a 10% hydrochloric acid solution at room temperature for 10 minutes for acid pickling. Then, the stainless steel plate was immersed into an iron oxalate treatment solution heated to 95° C. for 10 minutes to form an iron oxalate film coat at a rate of 6.5 g/m$^2$ on the surface.

The iron oxalate treatment solution used in the above process had been prepared by adding 30 g/l oxalic acid to an aqueous solution containing nitric acid by 5 g/l,hydrofluoric acid by 1.5 g/l.

The stainless steel plate specimen now carrying an iron oxalate film coat was then immersed in an acidic mixture of nitric acid and hydrofluoric acid (an aqueous solution containing nitric acid by 13% and hydrofluoric acid by 1.2%) at room temperature for 5 minutes to remove the iron oxalate film coat and washed with water immediately thereafter. Subsequently, the specimen was immersed in an 0.5% aqueous solution of γ-aminopropyltriethoxysilane (containing ethanol by 4.5%) for 30 seconds and dried at 100° C. for 10 minutes in a hot air dryer furnace to produce a thin layer of the silane coupling agent (about 0.02 $\mu$m thick). The obtained stainless steel specimen was measured for the surface roughness before and after the silane coupling treatment to see values of Ra=0.4 $\mu$m and Rz=2.7 $\mu$m for both before and after the treatment.

A 2 mm thick CR rubber piece was bonded onto the obtained stainless steel specimen. A total of 1,000 pieces were provided by a press punching process using a press frame with a profile as shown in FIG. 6 punching from the side of no CR rubber. The no good ratio was 0% (any piece where the rubber had been peeled, even if it is slightly, was counted as no good.)

Comparative Example 5

Specimens of shot blasted stainless steel plates having a profile as shown in FIG. 6 were degreased by a solvent (acetone wipe) and a CR rubber piece same as that of Embodiment Example 3 was bonded thereto immediately thereafter. The specimens were then subjected to a press punching process as in Embodiment Example 3 and the no good ratio was determined to be 52%. The obtained stainless steel specimens were measured for the surface roughness immediately after the shot-blast treatment to see values of Ra=0.71 $\mu$m and Rz=5.5 $\mu$m.

Embodiment Example 4

An aluminum plate (A1100, 70×300×0.3 mm) was bent by 90° to prepare an L-shaped specimen. The surface of the specimen was cleaned by means of an alkaline degreasing agent and then immersed into a aqueous solution containing 3% of suspended sodium fluorosilicate and heated to 90° C. for 2 minutes to form an aluminum sodium fluoride film coat at a rate of 11 g/m$^2$ on the surface.

The aluminum specimen now carrying an aluminum sodium fluoride film coat was then immersed in an 30% aqueous solution of nitric acid at room temperature for 3 minutes to remove the aluminum sodium fluoride film coat and washed with water immediately thereafter. Subsequently, the specimen was immersed in an aqueous solution containing 0.5% of γ-aminopropyltriethoxysilane (containing ethanol by 4.5%) for 30 seconds and dried at 100° C. for 10 minutes in a hot air dryer furnace to produce a thin layer of the silane coupling agent (about 0.02 $\mu$m thick). The obtained stainless steel specimen was measured for the surface roughness before and after the silane coupling treatment to see values of Ra=0.5 $\mu$m and Rz=3.7 $\mu$m for both before and after the treatment.

The obtained aluminum plate specimen was cut along the bent corner of the L-shape and an epoxy adhesive agent was applied to a side of each of the separated pieces (outer surface of the L-shaped specimen) to a thickness of 100 $\mu$m in a manner as described above for embodiment Example 1. 24 hours after the application of adhesive agent, each of the pieces was bent by 180° with the surface carrying the adhesive agent facing outside. As a result, no peeling off of the adhesive agent was observed in the bent area although fissures were found in that area.

Comparative Example 6

The surface of an L-shaped aluminum plate specimen same as the one used in Embodiment Example 4 was roughened by a wet honing operation conducted by using a single nozzle directed to the center of the bend of the L-shaped aluminum plate specimen to form an angle of 45°. The specimen was measured for the surface roughness at this stage to see values of Ra=0.4 μm and Rz=2.6 μm.

Then, an adhesive agent was applied to the aluminum plate and then bent at the center as in Embodiment Example 4. As a result, it was found that fissures had been produced in the bent area and the adhesive agent was peeled off partly therefrom.

Embodiment Example 5

A specimen of a titanium alloy plate (6Al-4V-Ti, 70×150×4 mm) having a surface cleaned by means of an alkaline degreasing agent and pickled by immersing into an acidic mixture of nitric acid and hydrofluoric acid (an aqueous solution containing 63.5% nitric acid by 200 g/l and 40% hydrofluoric acid by 30 g/l) at room temperature for 10 minutes for acid pickling. Then, the titanium alloy plate was immersed into an aqueous solution containing 2% acidic sodium fluoride and 0.1% sodium nitrite heated to 60° C. for 10 minutes to form a titanium sodium fluoride film coat at a rate of 23 g/m$^2$ on the surface.

The titanium alloy plate specimen now carrying a titanium sodium fluoride film coat was then immersed in 5% hydrochloric acid at room temperature for 1 minute to remove the titanium sodium fluoride film coat and washed with water immediately thereafter. Subsequently, the specimen was immersed in an 0.5% aqueous solution of γ-aminopropyltriethoxysilane containing ethanol by 4.5%) for 30 seconds and dried at 100° C. for 10 minutes in a hot air dryer furnace to produce a thin layer of the silane coupling agent (about 0.0 2 μm thick). The obtained specimen was measured for the surface roughness before and after the silane coupling treatment to see values of Ra=0.5 μm and Rz=3.7 μm for both before and after the treatment.

Then, an epoxy adhesive agent was applied to a side of the obtained titanium alloy plate specimen to a thickness of 100 μm in a manner as described above by referring to Embodiment Example 1. The specimen was bent at the center by 90° with the surface carrying the adhesive agent facing outside, 24 hours after the application of the adhesive agent. As a result, no peeling of the adhesive agent was observed in the bent area although fissures were found in that area.

Comparative Example 7

An adhesive agent was applied to a titanium alloy plate specimen prepared as in embodiment Example 5 and carrying a titanium sodium fluoride film coat and the specimen was subjected to a bending test without removing the titanium sodium fluoride film coat by means of hydrochloric acid to find that fissures had been produced in the bent area and the adhesive agent was peeled partly therefrom.

Embodiment Example 6

A specimen of a copper plate (C1100P, 70×150×2 mm) having a surface cleansed by means of an alkaline degreasing agent was immersed into an acidic mixture of chromic acid and sulfuric acid (a solution containing chromic anhydride by 0.5% and sulfuric acid by 2%) at room temperature in order to remove the oxide film on the surface and then immersed in a copper oxide treatment solution heated to a boiling state for 10 minutes to form a copper oxide film coat at a rate of 2.6 g/m$^2$ on the surface. The copper oxide treatment solution used in the above process had been prepared by adding copper sulfate to an aqueous solution containing nitric acid by 13 g/l so as to make it show a copper ion concentration of 3 g/l.

The copper plate specimen now carrying a copper oxide film coat was then immersed in the acidic mixture of chromic acid and sulfuric acid at room temperature for 3 minutes to remove the copper oxide film coat and washed with water immediately thereafter. Subsequently, the specimen was immersed in an aqueous solution containing 05 % of γ-aminopropyltriethoxysilane (containing ethanol by 4.5%) for 30 seconds and dried at 100° C. for 10 minutes in a hot air dryer furnace to produce a thin layer of the silane coupling agent (about 0.02 μm thick). The obtained specimen was measured for the surface roughness before and after the silane coupling treatment to see values of Ra=0.6 μm and Rz=3.0 μm for both before and after the treatment.

Then, an epoxy adhesive agent was applied to a side of the obtained copper plate specimen to a thickness of 100 μm in a manner as described above by referring to Embodiment Example 1. The specimen was bent by 90° with the surface carrying the adhesive agent facing outside, 24 hours after the application of the adhesive agent. As a result, no peeling of the adhesive agent was observed in the bent area although fissures were found in that area.

Comparative Example 8

An adhesive agent was applied to a copper plate specimen prepared as in Embodiment Example 6 and carrying a copper oxide film coat and the specimen was subjected to a bending test without removing the copper oxide film coat by means of the acidic mixture of chromic acid and sulfuric acid to find that fissures had been produced in the bent area and the adhesive agent was peeled partly therefrom.

ADVANTAGES OF THE INVENTION

As explained above by referring to Examples, a method according to the invention can produce appropriate etching pits on the surface of a metallic material and endows it with an excellent level of adhesiveness relative to an organic polymer material. However, no satisfactory adhesiveness will be obtained if the chemical etching process is not combined with the formation of a film coat (Comparative Example 1) or if the chemical etching process is combined with the formation of a film coat but not removing the film coat (Comparative Examples 2, 3, 7, 8). On the other hand, the use of a mechanical process such as shot blast can degrade the bonding effect with time (Comparative Example 4) and a satisfactory bonding effect will not be obtained depending on the profile of the metallic material to be treated (Comparative Example 6). Additionally, a sufficient degree of adhesiveness cannot be obtained by simply degreasing by means of a solvent (Comparative Example 5).

As described above, a surface treatment method of metal according to the invention employs a chemical process for producing etching pits on the surface so that it is less dependent on the profile of the metallic material than a mechanical process. Additionally, the unique etching process of the present invention can produce etching pits on the surface much easier than conventional processes.

A surface treatment method of metal according to the invention using the third step of forming a film layer on the treated surface can produce etching pits showing a more excellent bonding effect. Thus, a wide variety of metallic materials can be treated by a method according to the invention almost regardless of the surface condition. Additionally, the surface of the metallic material, which is treated by the third step and covered by a layer of a chemical compound, is inactive so that subsequent steps, including bonding it to an organic polymer material, can be conducted without haste. For this reason, the subsequent steps may be conducted at separate locations to give the method an enhanced flexibility.

What is claimed is:

1. A surface treatment process of a stainless steel surface comprising a first step in which etching pits are produced on said stainless steel surface accompanied with a formation of a film coat on said stainless steel surface by contacting said stainless steel surface with a first aqueous solution, said first aqueous solution comprising oxalic acid ion and hydrofluoric acid ion; and a second step in which the film coat is removed by contacting said stainless steel surface with a second aqueous solution, said second aqueous solution comprising a mixture of nitric acid and hydrofluoric acid, wherein said first step and said second step result in said stainless steel surface having a surface roughness of RZ: 1.5 to about Rz: 15.

2. A surface treatment process of a stainless steel surface according to claim 1, wherein the second step removes only said film coat without corroding the stainless steel surface.

3. A surface treatment process of stainless steel surface according to claim 1 wherein at least one of said first step or said second step is conducted by using electrolytic method.

4. A surface treatment process according to claim 1, wherein a third step of forming a layer of a third material on said stainless steel surface is further performed by using a third step solution after said second step.

5. A surface treatment process according to claim 4, wherein the third solution contains silane coupling agent.

6. A surface treatment process according to claim 4, wherein the third solution contains a chromate agent.

7. A surface treatment process according to claim 4 wherein the third solution is the same as the first aqueous solution.

* * * * *